US008545342B2

(12) United States Patent
Kim

(10) Patent No.: US 8,545,342 B2
(45) **Date of Patent: *Oct. 1, 2013**

(54) GOLF TRAINING APPARATUS AND METHOD

(71) Applicant: Sang Kim, Allendale, NJ (US)

(72) Inventor: Sang Kim, Allendale, NJ (US)

(73) Assignee: Ssam Sports, Inc., Allendale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/768,345

(22) Filed: Feb. 15, 2013

(65) Prior Publication Data

US 2013/0157773 A1 Jun. 20, 2013

Related U.S. Application Data

(63) Continuation of application No. 13/724,333, filed on Dec. 21, 2012.

(51) Int. Cl.
*A63B 69/36* (2006.01)

(52) U.S. Cl.
USPC ..... 473/280; 473/409

(58) Field of Classification Search
USPC ..... 473/200, 257, 280, 281, 351, 569, 473/588, 259, 409
See application file for complete search history.

(56) References Cited

U.S. PATENT DOCUMENTS

| | | | | |
|---|---|---|---|---|
| 2,884,254 | A * | 4/1959 | Miner | 473/200 |
| 3,796,435 | A * | 3/1974 | Dale | 473/200 |
| 4,278,254 | A * | 7/1981 | Simjian | 473/200 |
| D273,031 | S * | 3/1984 | Simjian | D21/709 |
| 4,494,757 | A * | 1/1985 | Simjian | 473/200 |
| 4,664,387 | A * | 5/1987 | Tardiff | 473/200 |
| 4,981,297 | A | 1/1991 | Foster | |
| D351,971 | S | 11/1994 | Cappola | |
| 5,478,612 | A | 12/1995 | Hack et al. | |
| D386,548 | S | 11/1997 | Cullen, III | |
| 6,004,220 | A | 12/1999 | Razzano | |
| 6,511,384 | B1 * | 1/2003 | Villacorta | 473/257 |
| D485,325 | S | 1/2004 | Rohan-Weaver | |
| D521,681 | S | 5/2006 | Xu | |
| D531,240 | S | 10/2006 | Geisendorfer | |
| D544,051 | S | 6/2007 | Takahira | |
| 7,300,357 | B2 * | 11/2007 | Breaker et al. | 473/280 |
| 7,347,790 | B2 | 3/2008 | Zimmerman | |
| D586,419 | S | 2/2009 | Tonkin | |
| 7,549,930 | B2 | 6/2009 | Rice | |
| D602,100 | S | 10/2009 | Wills | |
| D605,719 | S | 12/2009 | Bernal-Silva et al. | |
| D607,527 | S | 1/2010 | Bernal-Silva et al. | |
| 7,819,762 | B2 | 10/2010 | Bernal-Silva et al. | |

(Continued)

OTHER PUBLICATIONS

"Welcome to the Home of the Pill—Bring Focus to Your Game", The Pill, www.thepillgolf.com, on or after Jul. 14, 2012, [retrieved on: Feb. 7, 2013], 3 pages.

(Continued)

*Primary Examiner* — Nini Legesse
(74) *Attorney, Agent, or Firm* — Lowenstein Sandler LLP

(57) ABSTRACT

Disclosed in certain embodiments is a golf training aid comprising a spheroid segment comprising a dimpled outer circumferential surface, a first substantially flat base surface, and a second substantially flat base surface, wherein the first substantially flat base surface and the second substantially flat base surface are substantially parallel to each other and are substantially equal in size.

4 Claims, 11 Drawing Sheets

(56) References Cited

U.S. PATENT DOCUMENTS

| | | | | |
|---|---|---|---|---|
| D638,080 | S | 5/2011 | Armstrong | |
| 2003/0162603 | A1 * | 8/2003 | Breaker et al. | 473/280 |
| 2010/0124999 | A1 | 5/2010 | Wills | |
| 2010/0130299 | A1 | 5/2010 | Womersley et al. | |

OTHER PUBLICATIONS

International Search Report for and Written Opinion of the International Searching Authority for International Patent Application No. PCT/US2012/71294 mailed Mar. 29, 2013.

* cited by examiner

GOLF TRAINING APPARATUS AND METHOD

CROSS-REFERENCE TO RELATED APPLICATIONS

The present application is a continuation of U.S. patent application Ser. No. 13/724,333 filed on Dec. 21, 2012, titled "Golf Training Apparatus and Method," which claims the benefit of U.S. Provisional Application Ser. No. 61/597,807, titled "Golf Training Apparatus and Method," filed on Dec. 23, 2011, the entireties of which are herein incorporated by reference.

TECHNICAL FIELD

The present disclosure is in the field of golf training aids. More particularly, the present disclosure is in the field of training aids for putting a golf ball.

BACKGROUND

Most golf training aids focus on a specific adjustment of the golfer's body in making the golf swing. For example, a training aid that guides the putter head along a certain path. Or a device that aids in alignment so that the golfer can stroke the ball on the right path to the hole. However, there are many methods for swinging a golf club and many variables in a swing. Focusing on one method or aspect of a swing, like the path, typically results in faults in other variables associated with a proper club swing like the angle of the club, direction of the club face, etc. These variables are what make golf such a difficult game. Even with something as seemingly simple as a putting stroke, there are multiple swinging methods: straight back and thru, swinging across an arc, low above the ground, swinging down and up, among others. There are also many variables such as speed, direction, club face direction, angle of attack, etc. A training device that only focuses on one or two of these will invariably result in errors in the other areas, leaving the golfer stressed and confused.

OBJECTS AND SUMMARY

A more effective training device will not try to teach a specific swing type or a focus on a single swing variable. Instead, it will help the golfer find his or her own swing by providing direct and demonstrable feedback when a swing error occurs. However, providing this feedback is especially difficult in putting where a poor stroke is not as apparent as with a driver or an iron. With a driver or iron, a poor swing is fairly obvious—the distance, direction and curvature of the ball all indicate the quality of the swing. When putting a golf ball, however, such errors are not as obvious. These errors have a harmful effect because the margin of error in putting is very small—missing by as little as a fraction of an inch is enough to cost a stroke or more.

The above-described problems are addressed and a technical solution may be achieved by the golf training apparatus and method described herein. The apparatus and methods are designed so as to help a golfer learn proper putting techniques and an effective putting stroke by providing direct and demonstrable feedback if any errors are made in the putting stroke. The golf training aid will only roll properly (i.e., smoothly and in a straight line) if hit correctly. The slightest error in swing path, face angle of the putter, angle of attack, etc. will cause the golf training aid to wobble immediately off of the putter club face, lose its intended path, and curve away from the target.

Accordingly, it is an object of certain embodiments of the present invention to provide an apparatus that can be used as a golf training aid.

It is a further object of certain embodiments of the present invention to provide a method for training a golfer utilizing the apparatus as disclosed herein.

It is another object of certain embodiments of the present invention to provide a method for manufacturing the golf training aid as disclosed herein.

It is another object of certain embodiments of the present invention to provide a device for manufacturing the golf training aid as disclosed herein.

One or more of the above objects and others, may be met by the present invention which in certain embodiments, is directed to a golf training aid comprising a spheroid segment comprising a dimpled outer circumferential surface, a first base surface, and a second base surface.

In other embodiments, the curvature of the dimpled outer circumferential surface may vary. The golf training aid may also include weights that are strategically placed to vary the distribution of the mass which may vary the rolling characteristics.

In other embodiments, the present invention is directed to a method for training a golfer comprising placing, on a putting surface, a golf training aid comprising a spheroid segment comprising an outer circumferential surface, a first base surface, and a second base surface, and positioning the golf training aid such that a surface edge of the first base surface and a surface edge of the second base surface align in a direction of a target.

In other embodiments, the present invention is directed to a method for manufacturing a golf training aid comprising injecting a molding material into an injection mold having a cavity in the form of a spheroid segment comprising a dimpled outer circumferential surface, a first base surface, and a second base surface. The material can then be optionally cooled and removed from the mold.

In a further embodiment, the invention is directed to an injection mold having a cavity in the form of a spheroid segment comprising a dimpled outer circumferential surface, a first base surface, and a second base surface.

BRIEF DESCRIPTION OF THE DRAWINGS

The present disclosure will be more readily understood from the detailed description of examples presented below considered in conjunction with the attached drawings, of which.

It is to be understood that the attached drawings are for purposes of illustrating the concepts of this disclosure and are not meant to limit the present invention.

DETAILED DESCRIPTION

Examples of the present disclosure are directed to a golf training apparatus and method. In the following description, numerous details are set forth. It will be apparent, however, to one skilled in the art, that the present disclosure may be practiced without some or all of these specific details.

Figure 1:
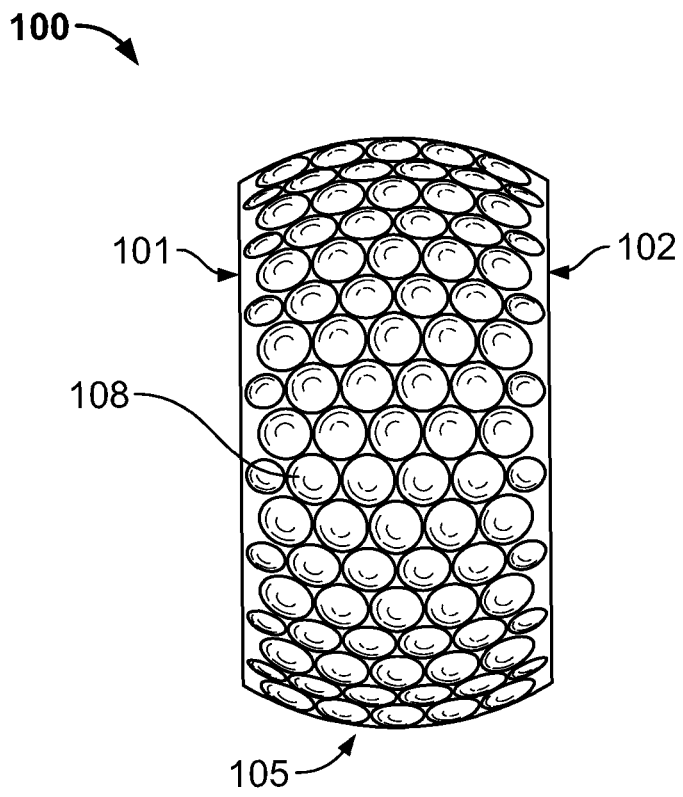
FIG. 1 depicts a top view of an example of the golf training aid.

FIG. 1 illustrates a top view of an example of the golf training aid 100, according to examples of the present disclosure. The golf training aid 100 may be a spheroid segment 105 that includes a first base surface 101, a second base surface 102, and a dimpled outer circumferential surface 108. As used herein, a spheroid is a three dimensional geometrical object that may be obtained by rotating an ellipse about one of its principal axes. If the generating ellipse is rotated about its major axis, the result is a prolate spheroid or elongated spheroid, similar to the shape of a rugby ball. If the generating ellipse is rotated about its minor axis, the result is an oblate spheroid or flattened spheroid, similar to the shape of a lentil. If the generating ellipse is a circle, then the spheroid is a sphere.

In one example, the spheroid segment 105 may resemble a segment of a regulation golf ball. In other words, the spheroid segment 105 may be a spherical segment. As such, the dimpled outer circumferential surface 108 may resemble the size, shape, depth, number, and distribution pattern of the dimples of a segment of a regulation golf ball.

In another example, the spheroid segment 105 may resemble a segment of a prolate spheroid, wherein the curvature of the dimpled outer circumferential surface 108 resulting spheroid segment 105 is less pronounced (e.g., flatter) than that of a spherical segment. In other words, the arc of the dimpled outer circumferential surface 108 of a prolate spheroid has a radius that is greater than that of a spherical segment.

In another example, the spheroid segment 105 may resemble a segment of an oblate spheroid, wherein the curvature of the dimpled outer circumferential surface 108 resulting spheroid segment 105 is more pronounced (e.g., sharper) than that of a spherical segment. Here, the arc of the dimpled outer circumferential surface 108 of an oblate spheroid has a radius that is less than that of a spherical segment.

In an example, the first base surface 101 and the second base surface 102 may be substantially flat, planar, disc-shaped surfaces. In one example, the first base surface 101 and the second base surface 102 may be parallel to each other. In another example, the first base surface 101 and the second base surface 102 may be equal in size.

The golf training aid 100 may be constructed from a material similar to the materials used in most regulation golf balls, such as, but not limited to, thermoplastic ionomer resin, balata rubber, solid rubber, hard plastic acrylic, surlyn, and polybutadiene, and a combination thereof. It is understood that a person of ordinary skill in the art recognizes that the golf training aid 100 may be constructed from other types of suitable materials.

In an example, a method for manufacturing a golf training aid may include the utilization of an injection mold defining a cavity having a spheroid segment comprising a dimpled outer circumferential surface, a first base surface, and a second base surface; and injecting a molding material into the mold. This method may produce the golf training aid 100 having smooth molded surface free of weld lines and molding defects.

The injection mold may include multiple mold sections which are removably mated along a parting plane to define the hollow cavity. The inner walls of the mold sections defining the cavity are provided with dimple-forming projections for forming the dimpled outer circumferential surface 108.

Figure 2:
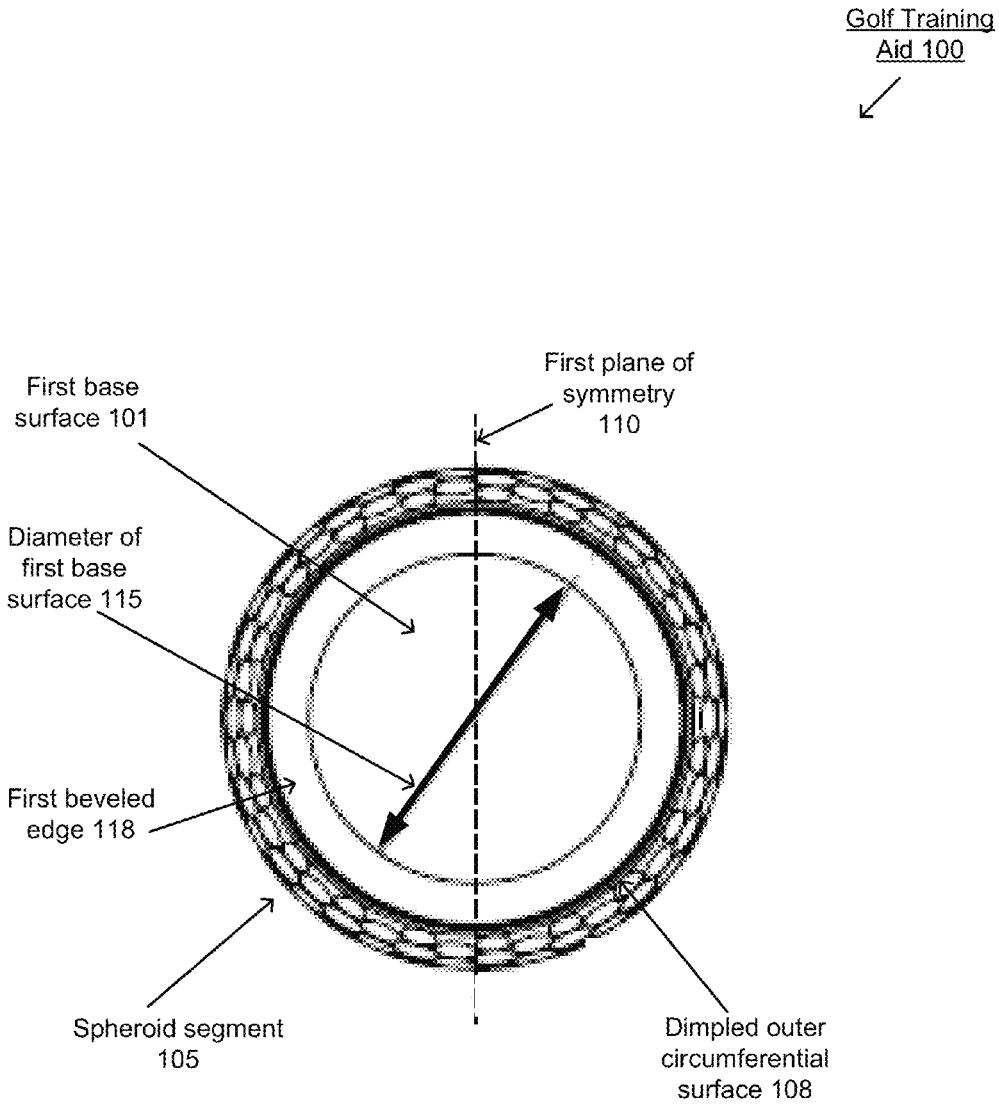
FIG. 2 illustrates a side view of an example of the golf training aid.

FIG. 2 illustrates a side view of an example of the golf training aid 100. The golf training aid 100 may include the spheroid segment 105, the first base surface 101, and the dimpled outer circumferential surface 108, as described above with reference to FIG. 1. The golf training aid 100 may be configured such that it may be symmetrical about a first plane of symmetry 110.

The physical dimensions of the golf training aid 100 may vary. In one example, the dimpled outer circumferential surface 108 may have a circumference that ranges from about 140 millimeters to 150 millimeters (the circumference of a standard golf ball is about 144 millimeters). In another example, the dimpled outer circumferential surface 108 may have a circumference that ranges from about 150 millimeters to 300 millimeters. In another example, the dimpled outer circumferential surface 108 may have a circumference that ranges from about 10 millimeters to 140 millimeters.

The perpendicular distance between the first base surface 101 and the second base surface 102 may range from about 14 millimeters to 40 millimeters. Also, the golf training aid 100 may have a weight that ranges from about 5 grams to about 100 grams.

Each dimple on the dimpled outer circumferential surface 108 may have a diameter that ranges from about 2 millimeters to 10 millimeters. The dimples may be laid out in an icosahedron pattern on the dimpled outer circumferential surface 108 to form substantially equilateral spherical triangles. The density of the dimples may range from about 6 dimples per square centimeter of surface area of the outer circumferential surface 108 to 10 dimples per square centimeter of surface area of the outer circumferential surface 108. In another example, the of surface area of the outer circumferential surface 108 may have a density that is less than 6 dimples per square centimeter or greater than 10 dimples per square centimeter.

The diameter 115 of the first base surface 101, as illustrated in FIG. 2, may range from about 23 millimeters to 33 millimeters. In another example, the diameter 115 may range from about 5 millimeters to 23 millimeters or from about 33 millimeters to 60 millimeters.

The golf training aid 100 may also include a first beveled edge 118. The first beveled edge 118 may be a circular-shaped edge connected to the first base surface 101 and to the dimpled outer circumferential surface 108. The dimensions of the first beveled edge 118 may vary such that the first beveled edge 118 may have a width of 30 millimeters or less.

Figure 3:
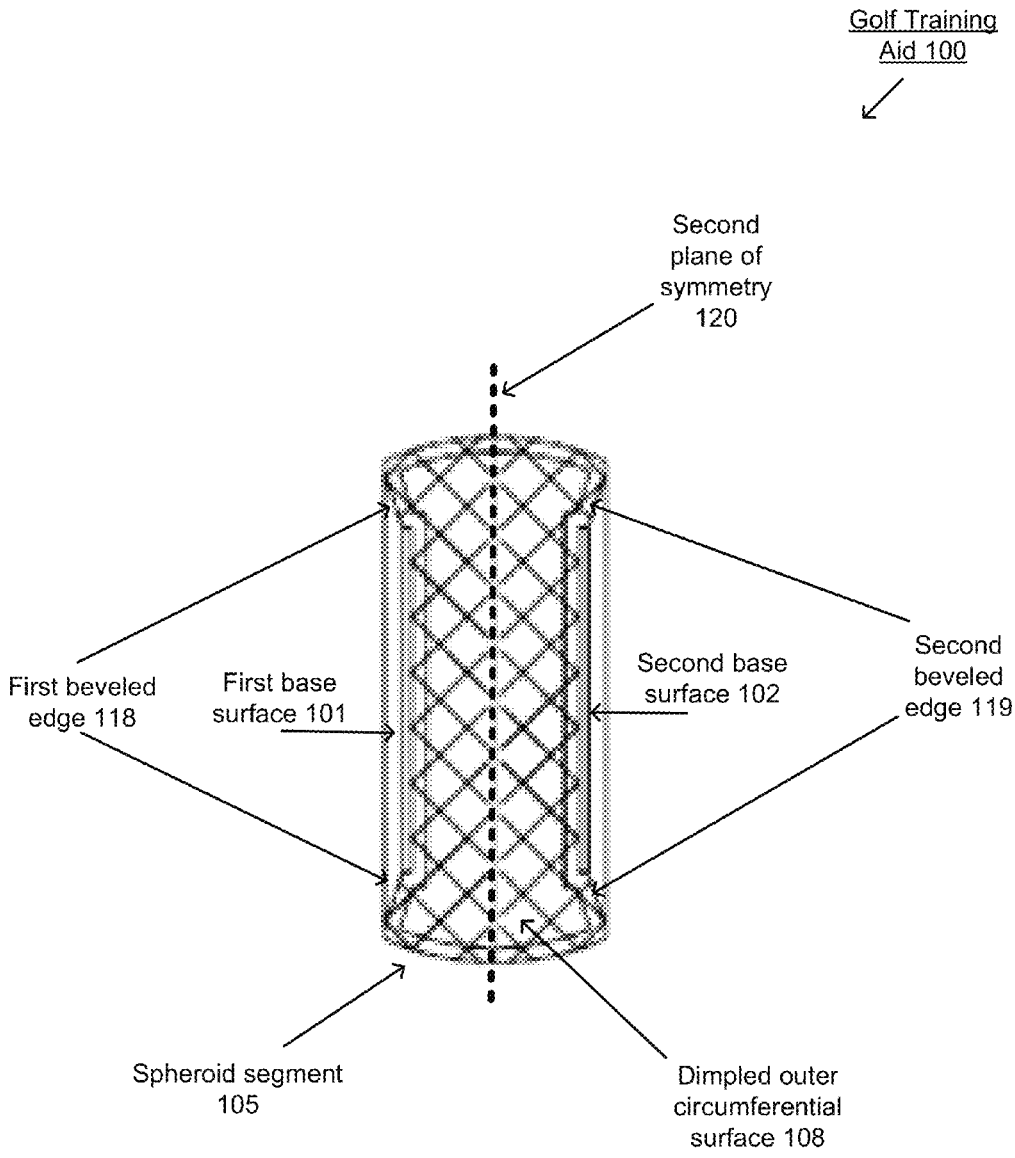
FIG. 3 shows a top cross-section view of an example of the golf training aid.

FIG. 3 shows a top cross-section view of an example of the golf training aid 100. The golf training aid 100 may include the spheroid segment 105, the first base surface 101, the second base surface 102, the first beveled edge 118, and the dimpled outer circumferential surface 108, as described above with reference to FIG. 1 and FIG. 2. The golf training aid 100 may also include a second beveled edge 119 connected to the second base surface 102 and also connected to the dimpled outer circumferential surface 108. The golf training aid 100 may be configured such that it may be symmetrical about a second plane of symmetry 120. Accordingly, the dimensions of the second base surface 102 and the second beveled edge 119 may be substantially equal to the dimensions of the first base surface 101 and the first beveled edge 118, respectively.

The first beveled edge 118 and the second beveled edge 119 may be substantially flat. In another example, the first beveled edge 118 and the second beveled edge 119 may be curved or rounded inward or outward with respect to the center of the golf training aid 100.

Figure 4A:
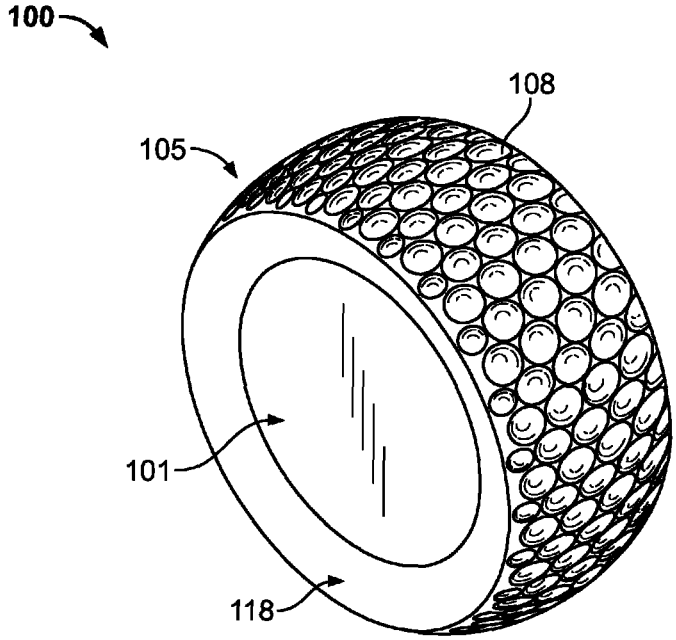
FIGS. 4A-4K depict examples of the golf training aid.

FIG. 4A depicts an angled view of an example of the golf training aid 100. The spheroid segment 105 may include the first base surface 101, the first beveled edge 118, and the dimpled outer circumferential surface 108, as described above.

The first base surface 101 and the second base surface 102 of the golf training aid 100 may be configured to allow for custom branding and logos by corporate customers. In another example, the golf training aid 100 may be configured to allow customizable stickers to be attached to the first base surface 101 and the second base surface 102.

In an example, the dimpled outer circumferential surface 108 may have a color that is different from the color of the first beveled edge 108. The contrast between the color of the dimpled outer circumferential surface 108 and the color of the first beveled edge 108 may be discernable to a golfer having ordinary skill. For example, the color of the dimpled outer circumferential surface 108 may be white while the color of the first beveled edge 108 may be red or black. The contrast in the color of the dimpled outer circumferential surface 108 and the first beveled edge 108 may visually accentuate a wobble when viewed as the golf training aid 100 rolls away from the golfer.

FIGS. 4B-4F depicts examples of the golf training aid 100 in accordance with some implementations of the present invention. FIGS. 4B-4F depicts examples in which the golf training aid 100 has a variance in the curvature of the dimpled outer circumferential surface 108.

Figure 4B:
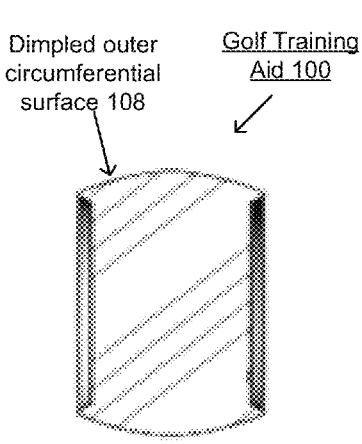

FIG. 4B illustrates an example cross-section of the golf training aid 100 that resembles a segment of a prolate spheroid. In other words, the curvature of the dimpled outer circumferential surface 108 is relatively flatter and less pronounced when compared to the curvature of a spherical segment. As a result, the golf training aid 100 may have less of a tendency to wobble when it is rolling toward a target if it is incorrectly hit by a golf club putter, when compared to a golf training aid 100 that is a spherical segment.

Figure 4C:
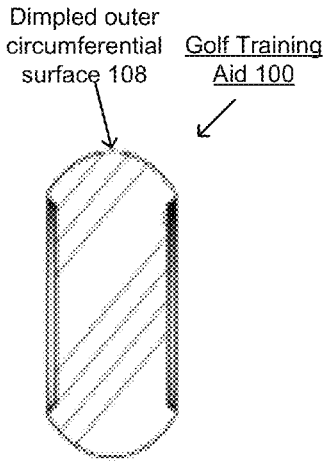

In contrast to the golf training aid 100 that resembles a segment of a prolate spheroid, FIG. 4C illustrates an example cross-section of the golf training aid 100 that resembles a segment of an oblate spheroid. In other words, the curvature of the dimpled outer circumferential surface 108 is relatively sharper and more pronounced when compared to the curvature of a spherical segment. As a result, the golf training aid 100 may have more of a tendency to wobble when it is rolling toward a target if it is incorrectly hit by a golf club putter, when compared to a golf training aid 100 that is a spherical segment.

Figure 4D:
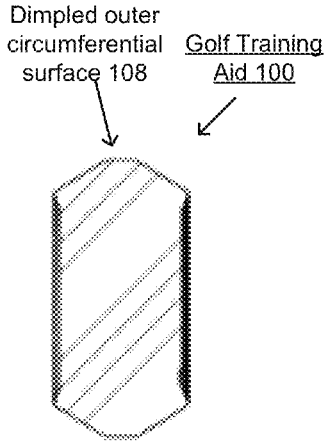
Figure 4E:
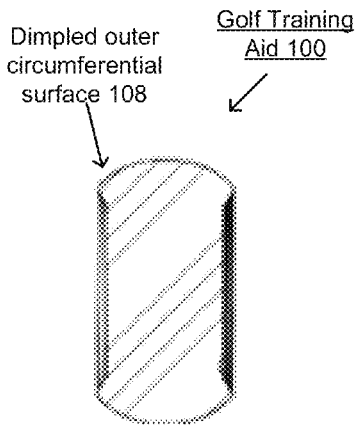
Figure 4F:
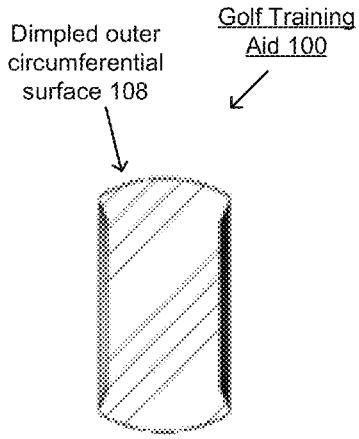

FIG. 4D illustrates an example cross-section of the golf training aid 100 in which the dimpled outer circumferential surface 108 includes sections that are substantially linear. FIG. 4E illustrates an example cross-section of the golf training aid 100 in which the curvature of the dimpled outer circumferential surface 108 varies from being more pronounced (e.g., sharper) towards the edge of the first and second base surfaces, and less pronounced towards the center. FIG. 4F illustrates an example cross-section of the golf training aid 100 in which the dimpled outer circumferential surface 108 is substantially spherical. Each of these examples may affect the tendency of the golf training aid 100 to wobble when it is rolling toward a target if it is incorrectly hit by a golf club putter, when compared to a golf training aid 100 that is a spherical segment.

FIGS. 4G-4K depicts examples of the golf training aid 100 in accordance with some implementations of the present invention. FIGS. 4G-4K depicts examples that include, but do not limit, the golf training aid 100 having a variance in the internal weight distribution which may alter the rolling characteristics.

The golf training aid 100 generally prefers to rotate about its center of mass. When the center of mass is not aligned with the axis of rotation, an unbalanced and unstable situation may result, causing an irregular and unpredictable rotational movement patterns when it is incorrectly hit by a golf club putter. For example, when the golf training aid 100 that has a center of mass that is not aligned with its axis of rotation is hit poorly, the golf training aid 100 may skid or veer off to one side before going into rotation. In another example, such a golf training aid 100 may not start rolling at all and just flop over.

Figure 4G:
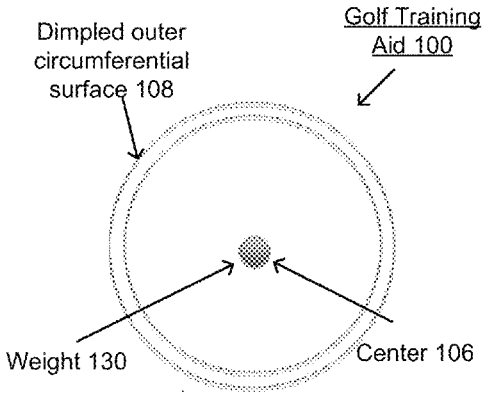

FIG. 4G illustrates a side view of the golf training aid 100 having a center 106, a dimpled outer circumferential surface 108, and a weight 130. The center 106 may be the center of the golf training aid 100 and aligned with an axis of rotation as the golf training aid is rolling toward a target. The weight 130 may be comprised of, but not limited to, materials having a high density or specific gravity such lead, steel, tungsten, or the like. In an example, the weight 130 may be cylindrically shaped. In another example, the weight 130 may be spherically shaped. In this example, the weight 130 is aligned with the center 106 such that the weight 130 is symmetrical about the center 106. In other words, in FIG. 4G, the distribution of the mass of the golf training aid 100 may be greater towards the center 106, thereby altering the rolling characterizes and the inertia of the golf training aid 100. For example, by increasing the distribution of the mass towards the center 106, the inertia of the golf training aid 100 may decrease. As a result, the golf training aid 100 may have more of a tendency to wobble when it is rolling toward a target if it is incorrectly hit by a golf club putter, when compared to a golf training aid 100 in which the mass is evenly and symmetrically distributed about the center 106.

Figure 4H:
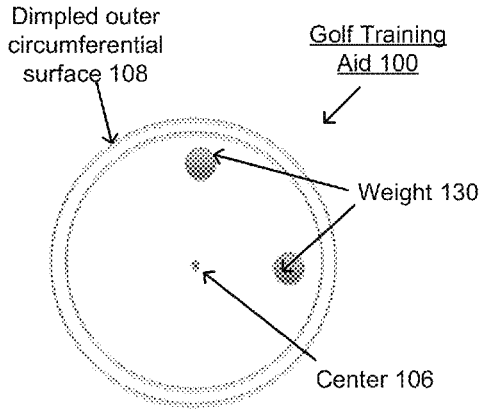

FIG. 4H illustrates a side view of the golf training aid 100 having a center 106 and multiple weights 130. As shown in FIG. 4H, the weights 130 are placed such that the mass distribution of the golf training aid 100 is unbalanced with respect to the center 106. As a result, the golf training aid 100 may have more of a tendency to wobble when it is rolling toward a target if it is incorrectly hit by a golf club putter, when compared to a golf training aid 100 in which the mass is evenly and symmetrically distributed about the center 106.

Figure 4I:
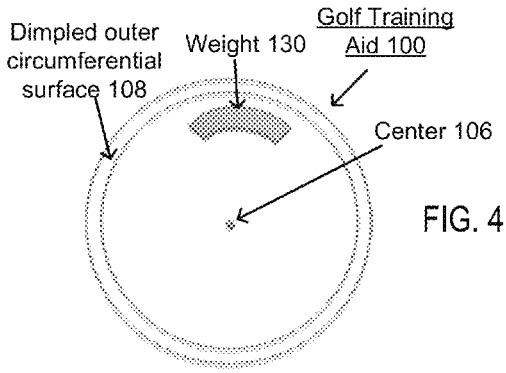

FIG. 4I illustrates a side view of the golf training aid 100 having a center 106 and a weight 130. As shown in FIG. 4I, the weight 130 may be shaped as a curved segment. It is noted that the weight 130 may be variously shaped, including, but not limited to, a ring, an oval, a rectangle, etc. The mass distribution of the golf training aid 100 of FIG. 4I is unbalanced with respect to the center 106. As a result, the golf training aid 100 may have more of a tendency to wobble when it is rolling toward a target if it is incorrectly hit by a golf club putter, when compared to a golf training aid 100 in which the mass is evenly and symmetrically distributed about the center 106.

Figure 4J:
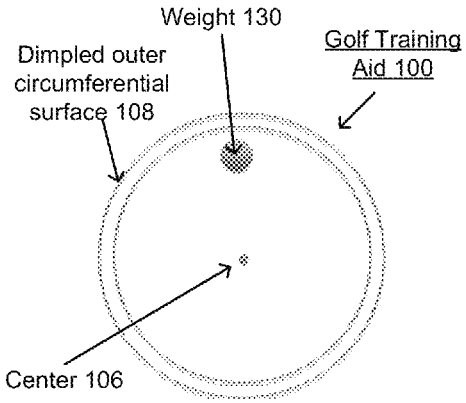
Figure 4K:
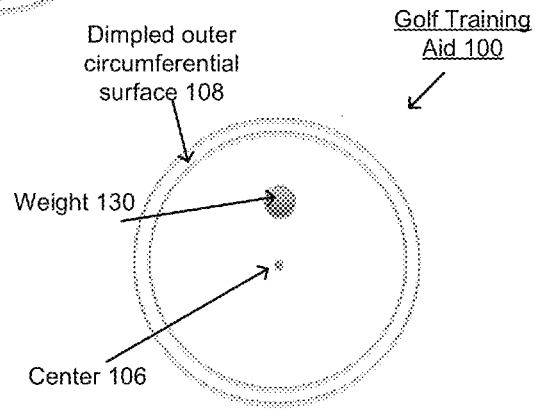

FIGS. 4J and 4K illustrate respective side views of the golf training aid 100 having a center 106 and a weight 130. As shown in FIG. 4J, the weight 130 may be placed near the dimpled outer circumferential surface 108. In contrast, in FIG. 4K, the weight 130 may be placed near the center 106. The distribution of the mass of the golf training aid 100 of FIGS. 4J and 4K are unbalanced with respect to the center 106. It is noted that the weight 130 may be variously positioned throughout the golf training aid 100. The various placement of the weight 130 within the golf training aid 100 may vary the inertial and rolling characteristics of the golf training aid 100, thereby, varying the tendency of the golf training aid to wobble when it is rolling toward a target if it is incorrectly hit by a golf club putter, when compared to a golf training aid 100 in which the mass is evenly and symmetrically distributed about the center 106.

Figure 5A:
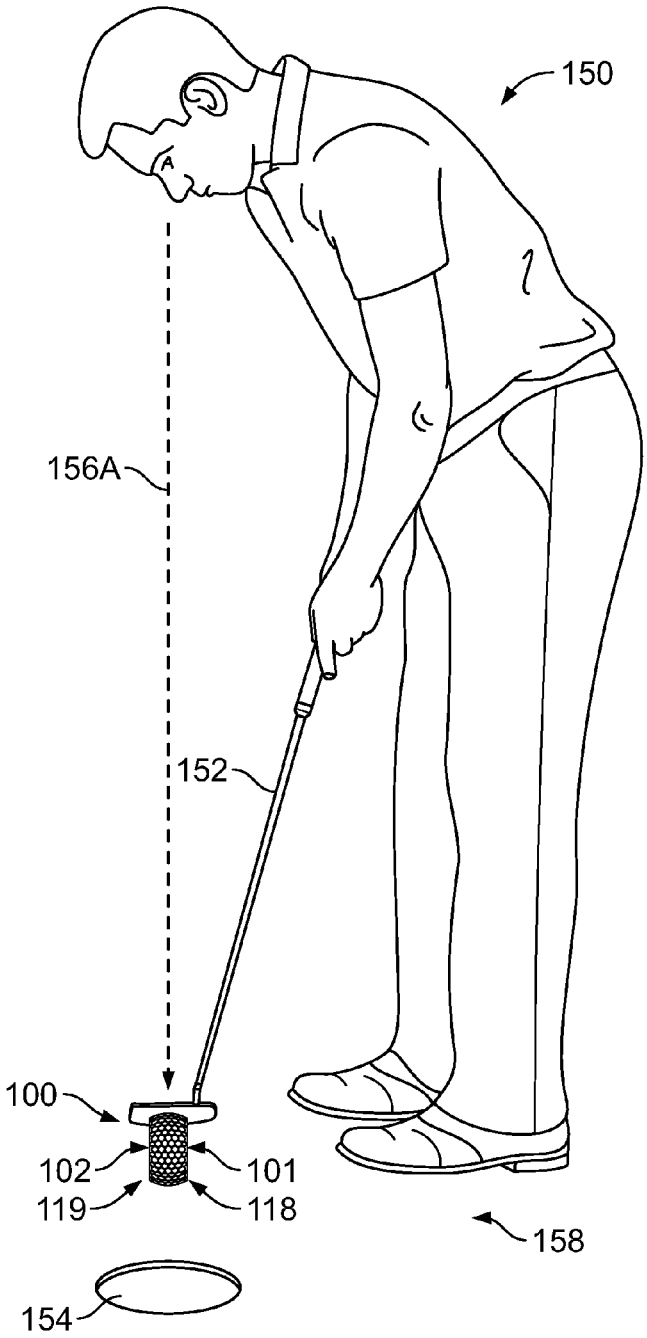
FIGS. 5A, 5B, and 5C illustrate examples of methods for training a golfer in accordance with examples of the present disclosure.

FIG. 5A illustrates an example of a method for training a golfer 150 in accordance with an example of the present disclosure. The golfer 150 may be any person who plays golf. The golfer 150 may be positioned on a putting surface 158. A putting surface 158 may be any surface for putting, including a grass putting green, or a practice facility such as a carpeted floor or a concrete floor. The putting surface may include a target 154, such as a standard golf hole or a practice putting cup.

The golfer 150 as shown in FIG. 5A is prepared to strike the golf training aid 100 with the golf club 152. The golf training aid 100 is positioned such that the plane of the first base surface 101 and the plane of the second base surface 102 align in the direction of the target 154. This allows the golfer 150 to visualize an imaginary path or track from the golf training aid 100 to the target 154. As such, the golf training aid 100 may teach the golfer 150 to properly line up the direction of the putt by properly aligning the golf training aid 100, the golfer's body, and the club path prior to striking the golf training aid 100 with the golf club 152.

The method also may help to train the golfer 150 with effective putting techniques with respect to the angle of the club face of the golf club 152. When the club face of the golf club 152 strikes the golf training aid 100 squarely or in a perpendicular orientation relative to the aligned position of the golf training aid 100, the golf training aid 100 rolls smoothly towards the target 154 without wobbling. However, failure to strike the golf training aid 100 with a square club face puts an initial bias on the golf training aid 100, causing a wobble and a curved trajectory away from the target 154.

The method also may help to train the golfer 150 with respect to the swing path of the golf club 152. When the path golf club 152 strikes the golf training aid 100 in a same direction relative to the aligned position of the golf training aid 100, the golf training aid 100 rolls smoothly towards the target 154 without wobbling. However, failure to swing the golf club along the same direction as the position of the golf training aid 100 puts an initial bias on the golf training aid 100, causing a wobble and a curved trajectory away from the target 154.

In one example, the golf training aid 100 may be a relatively wide spheroid segment 105 for a beginner golfer 150. A wide spheroid segment 105 may be more forgiving for minor swing errors and therefore may be more suitable for a beginner golfer 150. In another example, the golf training aid 100 may be a narrow spheroid segment 105 for an advanced golfer 150. A narrow spheroid segment 150 may be less forgiving for swing errors and may be more suitable for an advanced golfer 150. As an example, the perpendicular distance between the first base surface 118 and the second base surface 119 may be greater than 24 millimeters for a beginning-level golfer and may be 24 millimeters or less for an advanced-level golfer.

The golfer 150 as shown in FIG. 5A is positioned relative to the golf training aid 100 such that his or her line of eyesight 156A is directly over the golf training aid 100. When the golfer 150 is in the proper position to strike the golf training aid 100, the golfer 150 cannot see either the first beveled edge 118 or the second beveled edge 119 because his or her line of eyesight 156A is directly over the golf training aid 100.

Figure 5B:
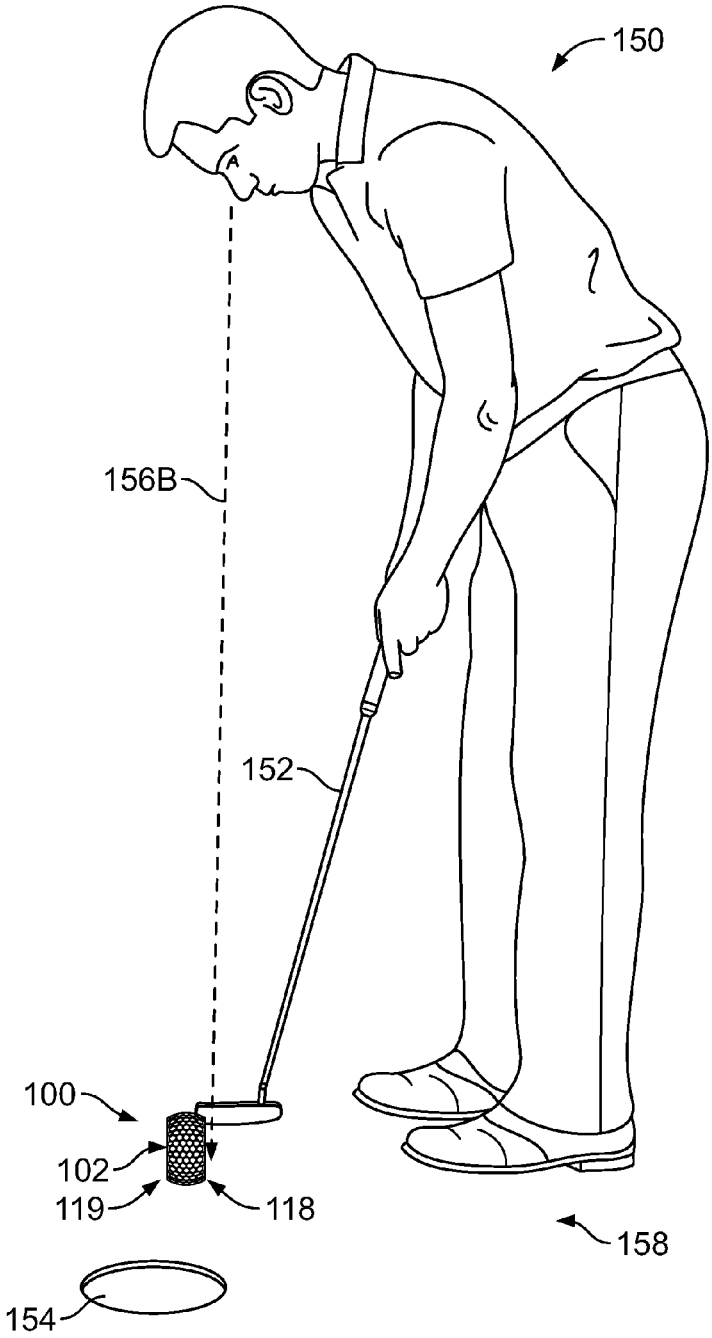

FIG. 5B illustrates an example of a method for training a golfer 150 in accordance with an example of the present disclosure. If the golfer 150 is positioned too far away from the golf training aid 100 such that the line of eyesight 156B is within viewing range of the first beveled edge 118, as shown in FIG. 5B, then the sight of the first beveled edge 118 may indicate to the golfer 150 that he or she is incorrectly positioned relative to the golf training aid 100.

Figure 5C:
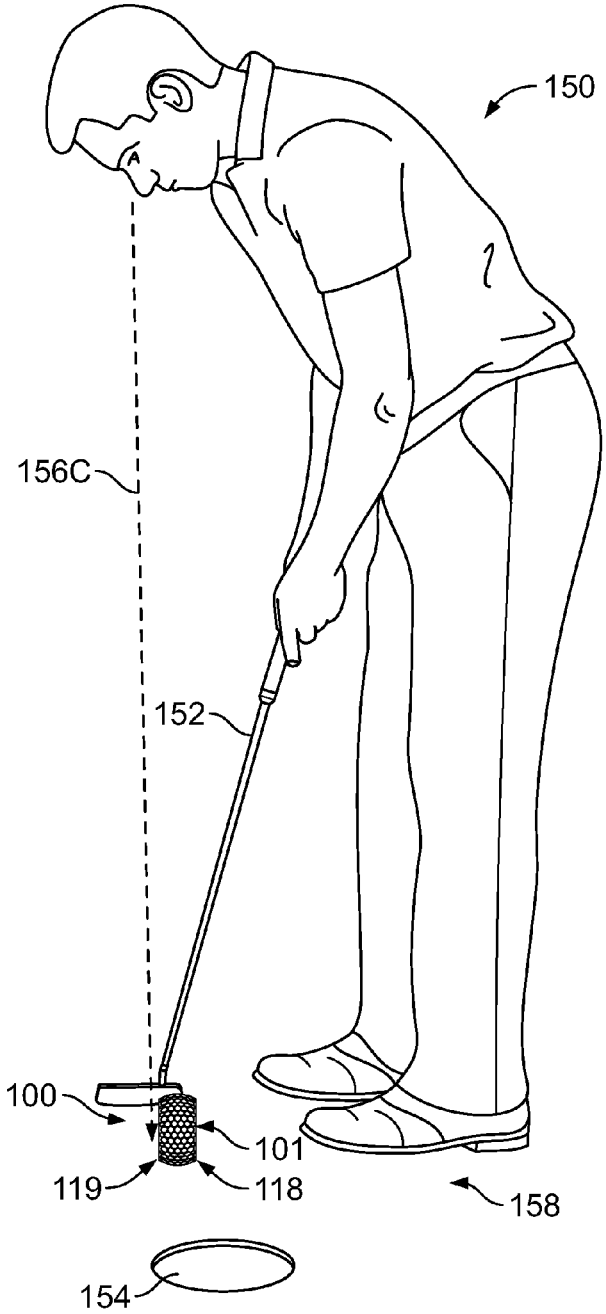

FIG. 5C illustrates an example of a method for training a golfer 150 in accordance with an example of the present disclosure. If the golfer 150 is positioned too close to the golf training aid 100 such that the line of eyesight 156C is within viewing range of the second beveled edge 118, as shown in FIG. 5C, then the sight of the second beveled edge 119 may indicate to the golfer 150 that he or she is incorrectly positioned relative to the golf training aid 100.

Figure 6:
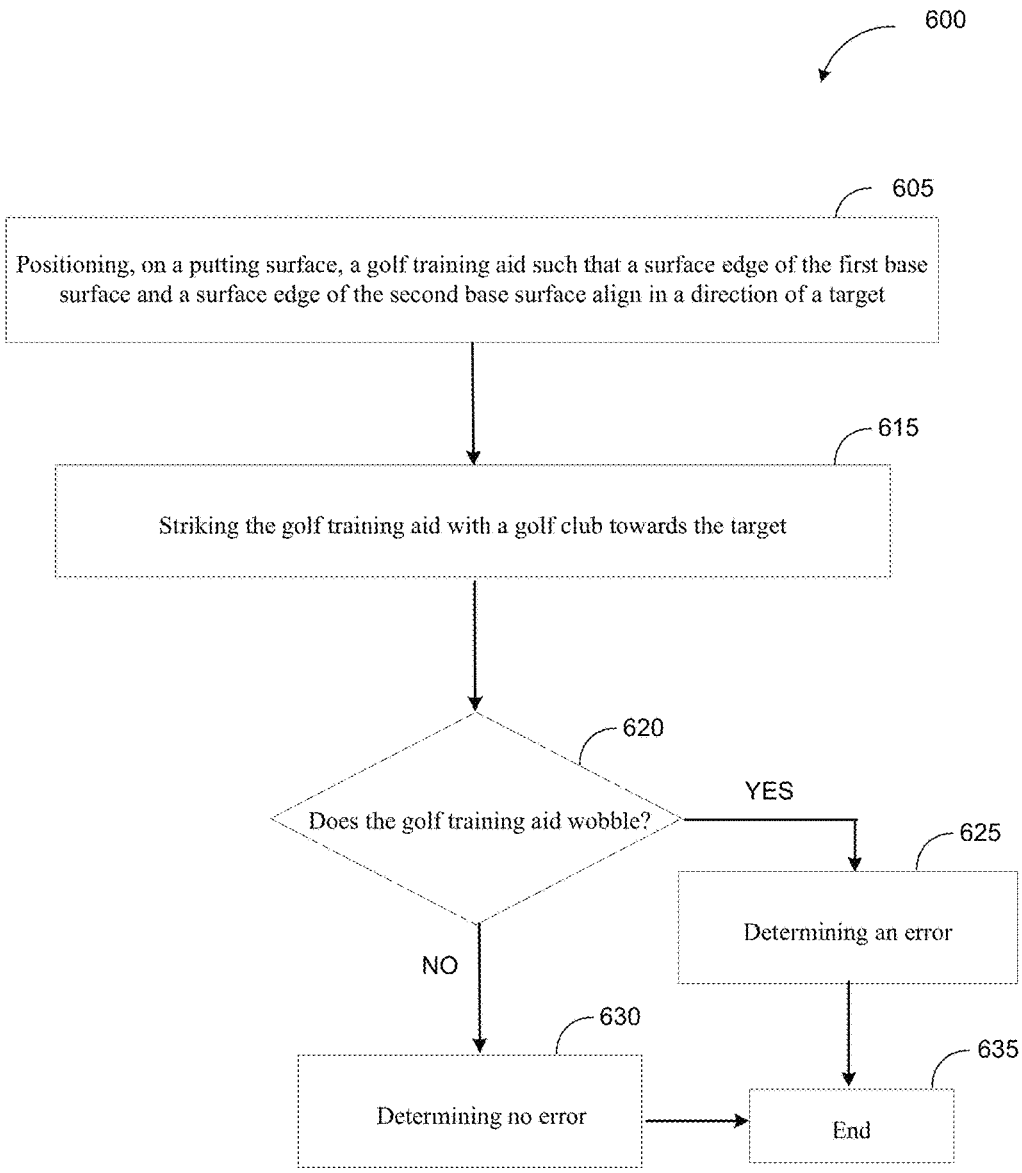
FIG. 6 is a flow diagram of a method for training a golfer in accordance with an example of the present disclosure.

FIG. 6 is a flow diagram of a method 600 for training a golfer 150 in accordance with an example of the present disclosure. The method may be performed using the previously described golf training aid 100.

Method 600 begins at block 605, which includes positioning, on the putting surface 158, the golf training aid 100 such that a plane or a surface edge of the first base surface 101 and a plane or a surface edge of the second base surface 102 align in a direction of the target 154, e.g., a putting hole or a practice putting cup. Block 615 includes striking the golf training aid 100 with the golf club 152 towards the target 154. At decision block 620, it is determined whether the golf training aid 100 wobbles or rolls smoothly. If it is determined that the golf training aid 100 wobbles, then at block 625 it is determined that there is an error, and the method 600 ends at block 635. However, if at decision block 620 it is determined that the golf training aid 100 rolls smoothly and does not wobble, then at block 630 it is determined that there is no error, and the method 600 ends at block 635.

Figure 7:
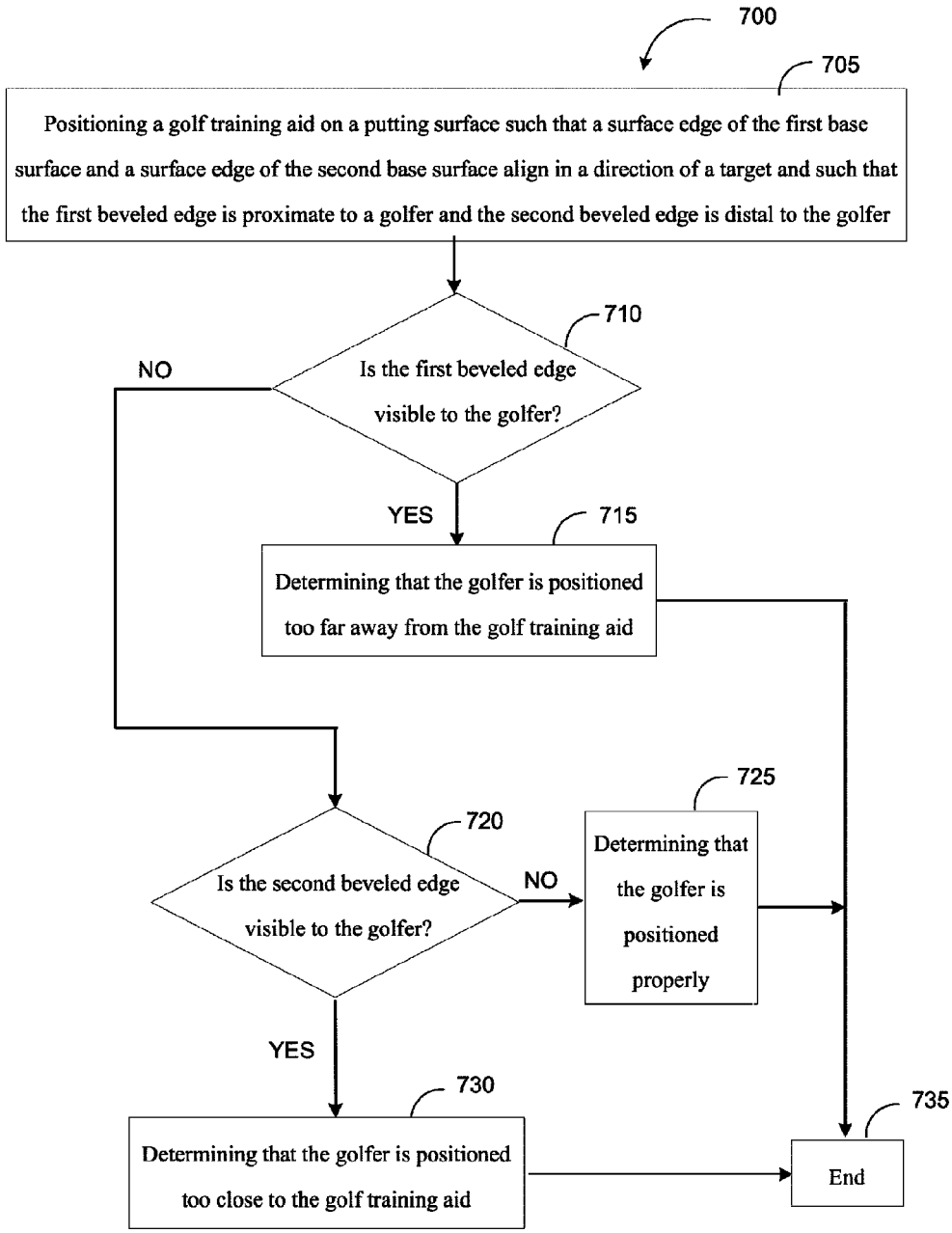
FIG. 7 is a flow diagram of a method for training a golfer in accordance with an example of the present disclosure.

FIG. 7 is a flow diagram of a method 700 for training a golfer 150 in accordance with an example of the present disclosure. The method may be performed using the previously described golf training aid 100.

Method 700 begins at block 705, which includes positioning the golf training aid 100 such that a plane or a surface edge of the first base surface 101 and a plane or a surface edge of the second base surface 102 align in a direction of the target 154, and such that the first beveled edge 118 is proximate to the golfer 150, and the second beveled edge 119 is distal from the golfer 150. At decision block 710, it is determined whether the first beveled edge 118 is visible to the golfer 150. If the first beveled edge 118 is visible to the golfer 150, then at block 715 it is determined that the golfer 150 is positioned too far away from the golf training aid 100, and the method 700 ends at block 735.

If at decision block 710 it is determined that the first beveled edge 118 is not visible to the golfer 150, then at decision block 720 it is determined whether the second beveled edge 119 is visible to the golfer 150. If the second beveled edge 119 is not visible to the golfer 150, then at block 725 it is determined that the golfer 150 is properly positioned, and the method 700 ends at block 735.

If at decision block 720 it is determined that the second beveled edge 119 is visible to the golfer 150, then at block 730 it is determined that the golfer 150 is positioned too close to the golf training aid 100, and the method 700 ends at block 735.

One having ordinary skill in the art will appreciate that the size, shape and placement of such structures may be varied depending on the particular application. Apart from the functional aspects the structures provide, they also provide a novel decorative element. One having ordinary skill in the art will appreciate the decorative possibilities such shapes present.

The foregoing description, for purposes of explanation, has been described with reference to specific examples. However, the illustrative discussions above are not intended to be exhaustive or to limit the disclosure to the precise forms disclosed. Many modifications and variations are possible in view of the above teachings. The examples were chosen and described in order to best explain the principles of the disclosure and its practical applications, to thereby enable others skilled in the art to best utilize the disclosure and various examples with various modifications as may be suited to the particular use contemplated.

What is claimed is:

1. A golf training aid comprising a spheroid segment comprising a dimpled outer circumferential surface, a first substantially flat base surface, a second substantially flat base surface, a first beveled edge connected to the first substantially flat base surface and to the dimpled outer circumferential surface and a second beveled edge connected to the second substantially flat base surface and to the dimpled outer circumferential surface, wherein the first substantially flat base surface and the second substantially flat base surface are substantially parallel to each other and are substantially equal in size, wherein the dimpled outer circumferential surface has a different color from the first and second beveled edges, to allow a user to ascertain proper positioning relative to the training aid.

2. A method for training a golfer comprising:

placing, on a putting surface, a golf training aid comprising a spheroid segment comprising an outer circumferential surface, a first substantially flat base surface, a second substantially flat base surface, a first beveled edge connected to the first substantially flat base surface and to the dimpled outer circumferential surface and a second beveled edge connected to the second substantially flat base surface and to the dimpled outer circumferential surface, wherein the first substantially flat base surface and the second substantially flat base surface are substantially parallel to each other and are substantially equal in size, and wherein the dimpled outer circumferential surface has a different color from the first and second beveled edges;

positioning the golf training aid such that the first beveled edge is proximate to a golfer and the second beveled edge is distal from the golfer; and determining that the golfer (i) is positioned too far away from the golf training aid when the golfer can see the first beveled edge; (ii) determining that the golfer is positioned too close to the golf training aid when the golfer can see the second beveled edge; or (iii) determining that the golfer is properly positioned when the golfer can neither see the first beveled edge or the second beveled edge.

3. The method of claim 2, further comprising:

striking the golf training aid with a golf club towards the target;

determining (i) an occurrence of an error when the golf training aid wobbles after being struck by the golf club; or (ii) determining no occurrence of an error when the golf training aid does not wobble after being struck by the golf club.

4. The method of claim 2, wherein outer circumferential surface further comprises a plurality of dimples.

* * * * *